United States Patent [19]

Moerre

[11] 4,268,106

[45] May 19, 1981

[54] FUSE HOLDER ASSEMBLY

[75] Inventor: Manfred Moerre, Warren, N.J.

[73] Assignee: The Singer Company, Stamford, Conn.

[21] Appl. No.: 89,669

[22] Filed: Oct. 30, 1979

[51] Int. Cl.[3] ..... H01H 85/22

[52] U.S. Cl. ..... 339/147 R; 337/194; 337/211; 339/150 F

[58] Field of Search ..... 339/147, 252 F, 253 F, 339/258 F, 259 F, 150 F; 337/228, 229, 230, 237, 194, 195, 196, 208, 211, 213

[56] References Cited

U.S. PATENT DOCUMENTS

| | | | |
|---|---|---|---|
| 1,469,439 | 10/1923 | Liversidge | 337/194 |
| 2,239,903 | 4/1941 | Schultz | 337/195 |
| 3,194,926 | 7/1965 | Ustin | 200/133 |
| 3,406,365 | 10/1968 | LaMeyre | 337/211 |
| 3,418,615 | 12/1968 | Canney | 337/190 |
| 3,590,320 | 6/1971 | Conroi | 337/194 |
| 3,659,252 | 4/1972 | Brown | 339/147 R |
| 3,936,787 | 2/1976 | Ranzanigo | 337/228 |
| 3,976,967 | 8/1976 | Magherini | 337/211 |
| 4,010,437 | 3/1977 | Macemon et al. | 337/204 |

*Primary Examiner*—John McQuade
*Attorney, Agent, or Firm*—David L. Davis; Robert E. Smith; Edward L. Bell

[57] ABSTRACT

A fuse holder assembly for a cartridge type fuse includes an elongated fuse carrier bar having a cylindrical opening in a fuse containment portion for loosely accepting the fuse therein. The fuse contacts include a conductive spring at the inward end of the assembly and a generally U-shaped spring fuse clip member at the outward end. The assembly includes a recess at its inward end to accept an end of the fuse carrier bar and when the carrier bar is inserted in the recess the inward end of the fuse is brought into contact with the spring. The fuse carrier bar is then pivoted to cause the outward end of the fuse to be captured by the fuse clip. To remove a fuse, the fuse carrier bar is pivoted to pull the fuse out of contact with the fuse clip and the fuse carrier bar is then removed by being pulled outward from the assembly. To insure that only the proper size fuse is placed in circuit, a unique spacing is provided between the spring contact and the fuse clip in the location reserved for that size fuse.

4 Claims, 3 Drawing Figures

FUSE HOLDER ASSEMBLY

DESCRIPTION

BACKGROUND OF THE INVENTION

This invention relates to fuse holder assemblies and, more particularly, to fuse holder assemblies adapted to receive fuses of the cartridge type.

It is common practice to provide fuse protection for electrically powered appliances, and the like. A common type of fuse utilized for in-line protection is what is known as a cartridge type fuse, which is ordinarily a small cylindrical cartridge having a diameter on the order of one-fourth inch. Such cartridge fuses generally comprise an insulated tube closed at both ends by conductive end caps, having internally disposed therebetween a fuse bus connecting the end caps. The end caps are adapted to be conductively engaged by respective fuse clips connected to the ends of respective leads. In this manner the fuse closes the circuit between the respective fuse clips and upon removal thereof at least one of the fuse clips is usually energized, presenting a hazard of shock and injury to the installer. A further problem is that it is often difficult to grasp the fuse to remove it from the fuse clip, especially where the fuse is mounted in a confined space. Thus, many different types of devices have been proposed in the prior art which are specifically adapted to provide a means for insulated manual grasping of the cartridge fuse without unnessarily exposing the installer to shock hazard. However, these devices have not proven to be entirely satisfactory due to, for example, difficulty of use.

It is therefore an object of this invention to provide a fuse holder assembly for a cartridge type fuse that substantially eliminates the possibility of a shock hazard while the fuse is beinginserted or removed.

It is another object of this invention to provide such an assembly which is easy to use.

It is a further object of this invention to provide a fuse holder assembly which may be mounted in a confined space.

SUMMARY OF THE INVENTION

The foregoing and additional objects are attained in accordance with the principles of this invention by providing a fuse holder assembly for a cartridge fuse which includes a support member, a fuse clip mounted on the support member and a spring contact member mounted on the support member. The spring contact member is spaced from the fuse clip so that a cartridge fuse may have the spring contact member bearing against one end and the other end held by the fuse clip. A fuse carrier bar is provided having a containment portion adapted to receive therein an intermediate portion of a cartridge type fuse. There is further provided a fuse carrier bar holder mounted on the support member in a location proximate the spring contact member and adapted to receive an end of the carrier bar and allow pivotal motion of the carrier bar so that a fuse within the containment portion of the carrier bar may have a first end brought against the spring contact member and the second end pivoted into engagement with the fuse clip.

In accordance with an aspect of this invention, there is further provided means for guiding the end of the carrier bar into the holder.

In accordance with another aspect of this invention, the fuse carrier bar includes a projecting stop to limit movement of a fuse due to the force exerted thereon by the spring contact member.

BRIEF DESCRIPTION OF THE DRAWINGS

The foregoing will be more readily apparent upon reading the following description in conjunction with the drawings wherein.

DETAILED DESCRIPTION

Figure 1:
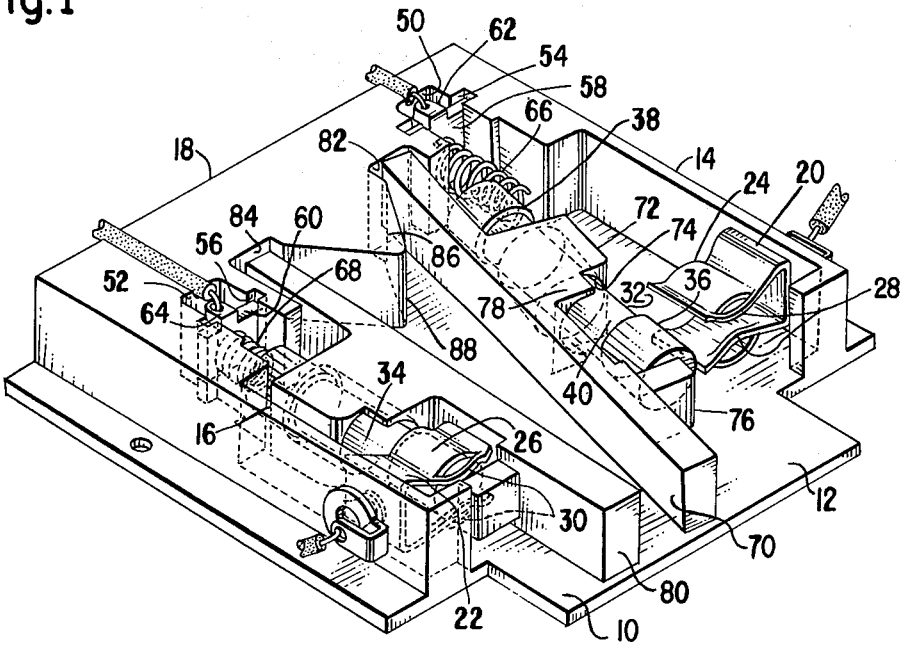
FIG. 1 is a perspective view of a fuse holder assembly constructed in accordance with the principles of this invention.

Referring now to the drawings, wherein like elements in different figures thereof have the same reference character applied thereto, the fuse holder assembly according to the present invention includes a support base 10. The base 10 is preferably molded from a plastic material and is a unitary structure formed with a recessed portion defined by a floor 12, a pair of relatively thin side walls 14 and 16, and a rear wall 18.

Mounted on each of the side walls 14, 16 is a respective fuse clip 20, 22. Each of the fuse clips 20, 22 is generally U-shaped having a generally cylindrically shaped portion 24, 26, and inwardly projecting portions 28, 30, for receiving therein a conductive end of a cartridge fuse 32, 34, respectively. The cartridge fuse 32 is generally cylindrical in shape and includes a pair of conductive metal end caps 36 and 38 as well as an insulative portion 40 intermediate the end caps 36 and 38. Similarly, the cartridge fuse 34 is generally cylindrical in shape and includes a pair of conductive metal end caps 42 and 44 as well as an insulative portion 46 intermediate the end caps 42 and 44.

Figure 2:
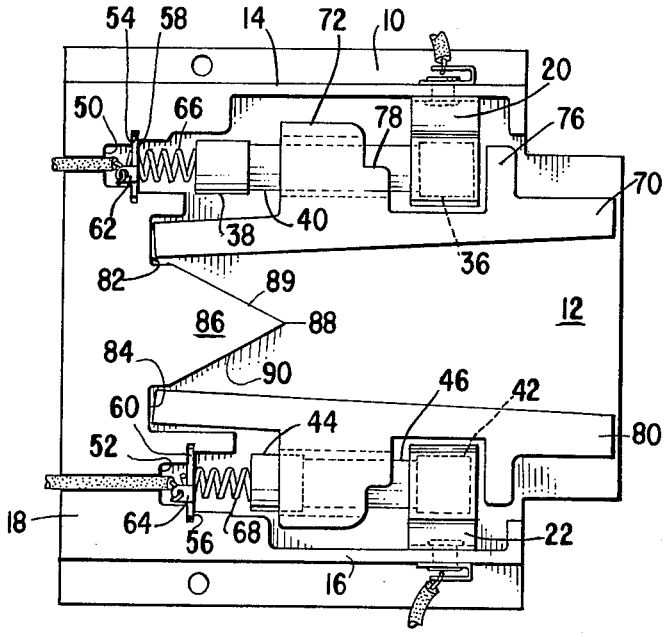
FIG. 2 is a top plan view of the fuse holder assembly of FIG. 1.

The rear wall 18 has formed therein a pair of recessed portions 50, 52 which have transversely extending slits 54, 56, respectively. The slits 54, 56 each accept a respective contact pad 58, 60, each of which has a bent over terminal tab 62, 64, respectively. The contact pads 58, 60 only extend partway down the transverse slits 54, 56. At the lower end of the recesses 50, 52, and resting on the floor 12, are a pair of conductive coil spring contact members 66, 68, the lower edges of the contact pads 58, 60 being inserted between adjacent coils of the springs 66, 68, respectively, to both hold the springs 66, 68 in place and to make conductive contact therewith. The spring contact member 66 is spaced from the fuse clip 20 a sufficient distance so that the spring 66 may bear against the end cap 38 of the cartridge fuse 32 while the end cap 36 is held by the fuse clip 20, the spring contact member 66 being slightly compressed to maintain good conductive contact with the end cap 38. Likewise, the spring contact member 68 is appropriately spaced from the fuse clip 22. It is noted from the drawings, especially FIG. 2, that the spacing between the spring contact member 66 and the fuse clip 20 is different from the spacing between the spring contact member 68 and the fuse clip 22. The reason for this difference of spacing is to illustrate how different size fuses may be accommodated by the fuse holder assembly described herein, so that an improperly sized fuse cannot be inserted in the wrong space. Although a fuse holder assembly for two differently sized fuses is shown, it is contemplated that a fuse holder assembly for any number of fuses of equal or different sizes, comes within the scope of this invention.

To hold a cartridge fuse so that it may be readily inserted or removed from the fuse holder assembly, an elongated fuse carrier bar 70 is provided. The carrier bar 70 is formed of insulative material and preferably is molded from a plastic material. The carrier bar 70 has projecting therefrom an open ended fuse containment portion 72 having a cylindrical opening for loosely accepting the fuse 32 therein. A projecting stop 76 is also provided on the carrier bar 70 to limit outward movement of the fuse 32. The fuse containment portion 72 is further formed with a boss 78 which prevents outward movement of the carrier bar 70 when the fuse 32 is engaged by the fuse clip 20 by bearing against the fuse clip 20, for a reason to be described hereinafter. Similarly, a fuse carrier bar 80 is provided for the fuse 34. It is noted that although the fuses 32 and 34 may be of different sizes, the fuse carrier bars 70 and 80 may be identical.

Formed within the rear wall 18 are a pair of recesses 82, 84, in locations proximate the spring contact members 66, 68, respectively. The recesses 82, 84 function as holders for the inward ends of the carrier bars 70, 80, and allow pivotal motion of the carrier bars 70, 80 so that fuses contained within the containment portions of the carrier bars may have a first end brought against the spring contact members and the second end pivoted into engagement with the fuse clips. The boss 78 prevents the fuse carrier bar 70 from slipping out of the recess 82 until after pivotal motion thereof releases the fuse 32 from the fuse clip 20.

Figure 3:
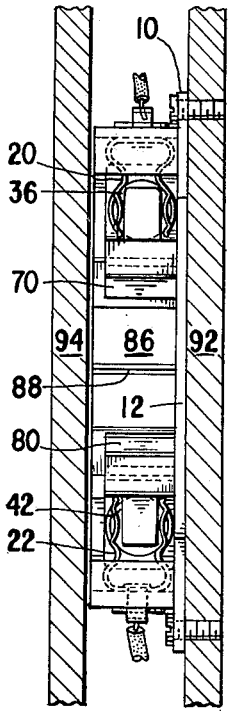
FIG. 3 is an end view of the fuse holder assembly of FIG. 1 shown mounted in a confined space.

As shown in FIG. 3, the fuse holder assembly according to the present invention is particularly well adapted for mounting in a confined narrow space, for example between walls 92, 94. The fuse holder assembly according to the present invention has been designed so that an installer may easily insert or remove a fuse through this narrow width opening. Thus, to remove the fuse 32, the installer merely inserts his fingers within the confines of the narrow space and grabs the outward end of the carrier bar 70. Using this outward end as a handle, the carrier bar 70 is then pivoted to disengage the end cap 36 from the fuse clip 20 and the carrier bar, with the fuse contained within the containment portion 72, is then pulled outward from the fuse holder assembly. To insert the cartridge fuse 32, it is first placed within the opening 74 of the containment portion 72. The carrier bar 70 is then inserted within the narrow width opening so that its inward end goes into the recess 82, at which time the end cap 38 is brought to bear against the spring contact member 66. The projecting stop 76 prevents the fuse 32 from being forced out of the containment portion 72 by the spring 66. The fuse carrier bar 70 is then pivoted until the end cap 36 is forced into the cylindrical portion 24 of the fuse clip 20. Since the foregoing operation is performed within a narrow space with limited visibility, guide means for assisting the installer in inserting the carrier bar into the recesses 82, 84 is provided. This guide means takes the form of a triangular shaped projection 86 formed on the rear wall 18, with the apex 88 of the triangular shaped portion 86 pointing outwardly therefrom, and sides 89, 90 sloping toward the recesses 82, 84, respectively.

Accordingly, there has been disclosed an improved fuse holder assembly particularly adapted for mounting within a confined space, which assembly provides ease of use in installing or removing a cartridge fuse. It is understood that the above-described embodiment is merely illustrative of the application of the principles of this invention. Numerous other embodiments may be devised by those skilled in the art without departing from the spirit and scope of this invention, as defined by the appended claims.

We claim:

1. A fuse holder assembly for a cartridge type fuse comprising:

a support member formed with a side wall and a rear wall;

a fuse clip mounted on the side wall of said support member;

a spring contact member mounted on said support member and spaced from said fuse clip so that a cartridge type fuse may have the spring contact member bearing against one end and the other end held by said fuse clip;

an elongated fuse carrier bar having a containment portion projecting therefrom and adapted to receive therein an intermediate portion of a cartridge type fuse; and a fuse carrier bar holder mounted on said support member in a location proximate said spring contact member, said holder being formed as a recess in the rear wall of said support member and adapted to receive an end of said carrier bar and allow pivotal motion of said carrier bar so that a fuse within the containment portion of said carrier bar may have a first end brought against said spring contact member and the second end pivoted into engagement with said fuse clip.

2. The fuse holder assembly according to claim 1 wherein said fuse carrier bar includes a projecting stop to limit movement of a fuse due to the force exerted thereon by said spring contact member.

3. The fuse holder assembly according to claim 1 further including guide means for guiding said end of said carrier bar into said holder.

4. The fuse holder assembly according to claim 3 wherein said guide means is formed as a projection of said rear wall adjacent said recess, said projection having a side sloped toward said recess.

* * * * *